252-9 AU 157 E4
5/27/86 GB 4,591,449

United States Patent [19]
Goedhart et al.

[11] Patent Number: 4,591,449
[45] Date of Patent: May 27, 1986

[54] DISHWASHING COMPOSITION

[75] Inventors: Machiel Goedhart, Rozenburg; Franciscus H. Gortemaker, Mijnsheerenland; Hermanus C. Kemper, Brielle; Hendrik S. Kielman, Maassluis, all of Netherlands

[73] Assignee: Lever Brothers Company, New York, N.Y.

[21] Appl. No.: 660,605

[22] Filed: Oct. 12, 1984

[30] Foreign Application Priority Data

Oct. 20, 1983 [GB] United Kingdom ..... 8328078

[51] Int. Cl.[4] ..... C11D 9/42
[52] U.S. Cl. ..... 252/99; 252/95; 252/140; 252/174.21; 252/174.25

[58] Field of Search ..... 252/99, 113, 120, 121, 252/128, 131, 140, 155, 173, 174.21, 174.25, 95, DIG. 19

[56] References Cited

U.S. PATENT DOCUMENTS

| | | | |
|---|---|---|---|
| 4,005,027 | 1/1977 | Hartmann | 252/95 |
| 4,116,851 | 9/1978 | Rupe et al. | 252/103 |
| 4,166,039 | 8/1979 | Wise | 252/133 |
| 4,397,755 | 8/1983 | Brierley et al. | 252/140 |

*Primary Examiner*—Paul Lieberman
*Assistant Examiner*—John F. McNally
*Attorney, Agent, or Firm*—Milton L. Honig; James J. Farrell

[57] ABSTRACT

The use of a layered clay, e.g. a synthetic hectorite, in a non-enzymatic machine dishwashing composition provides for a significant reduction of spot and film formation.

4 Claims, No Drawings

DISHWASHING COMPOSITION

The present invention relates to a machine dishwashing composition with reduced spot-formation properties.

Machine dishwashing compositions usually consist of a mixture of alkaline salts, a bleaching agent, a surfactant and minor ingredients. The alkaline salts are usually selected from the polyphosphates and silicates. Such machine dishwashing compositions are used in the main wash step of machine dishwashing and in general have a satisfactory cleaning performance.

However, frequently the articles cleaned with such products still do not have a satisfactory visual appearance after rinsing and drying, showing film or spots. Sometimes some main wash liquor is carried over from the main wash step to the rinse step, causing some deposition on the articles to be cleaned, sometimes the consumer does not dose the main wash product according to instructions, thus causing an insufficient removal of soil, etc. Usually, in the machine dishwashing operation a rinse aid is added to the rinse liquor to improve the visual appearance of the articles when dry, but this may make the overall dishwashing operation more expensive.

It has now been found that the inclusion of an effective level of a layered clay in such conventional machine dishwashing compositions significantly reduces the formation of spots on the cleaned articles.

The layered clay minerals suitable for use in the present invention belong to the geological classes of the smectites, the kaolins, the illites, the chlorites, the attapulgites and the mixed layer clays. Typical examples of specific clays belonging to these classes are:

smectites, e.g. montomorillonite, bentonite, pyrophyllite, hectorite, saponite, sauconite, nontronite, talc, beidellite, volchonskoite, vermiculite; kaolins, e.g. kaolinite, dickite, nacrite, antigorite, anauxite, halloysite, indellite, chrysotile;

illites, e.g. bravaisite, muscovite, paragonite, phlogopite, biotite;

chlorites, e.g. corrensite, penninite, donbassite, sudoite, pennine, clinochlore;

attapulgites, e.g. sepiolite, polygorskyte; mixed layer clays, e.g. allevardite, vermiculitebiotite.

The layered clay minerals may be either naturally occurring or synthetic. Preferred clay minerals for use in the present invention are natural or synthetic hectorites, montmorillonites and bentonites, and of these the hectorites are especially preferred. Many of the above clays are commercially available, and typical examples of commercial hectorites are the Laponites ex Laporte Industries Ltd, England; Veegum Pro and Veegum F ex R. T. Vanderbilt, U.S.A.; the Barasyms, Macaloids and Propaloids ex Baroid Division, National Read Comp., U.S.A.

Particularly preferred commercial hectorites are Laponite S, Laponite XLS, Laponite RD and Laponite RDS, of which Laponite XLS is especially preferred. This is a synthetic hectorite having the following characteristics: analysis (dry basis) $SiO_2$ 59.8%, MgO 27.2%, $Na_2O$ 4.4%, $Li_2O$ 0.8%, structural $H_2O$ 7.8%, with the addition of tetrasodium pyrophosphate (6%); specific gravity 2.53; bulk density 1.0.

The effective level of the layered clay in the machine dishwashing composition generally ranges from 0.001–40%, usually from 0.1–30%, preferably from 0.5–20% and particularly preferably from 1–10% by weight of the composition.

The machine dishwashing composition may furthermore comprise the usual ingredients of machine dishwashing compositions. Thus it may contain one or more alkali salts commonly used in dishwashing compositions. Thus, it may contain organic and/or inorganic builder salts such as the alkali metal ortho-, pyro and tripolyphosphates and hexametaphosphates, silicates, carbonates, borates, citrates, carboxymethyloxysuccinates, nitrilotriacetates and ethylenediaminetetraacetates, polymeric polyelectrolytes such as polyacrylates, polymaleates, and other known organic and inorganic builder compounds.

Usually, the amount of alkali salts in the composition varies from 10–90% weight, generally from 30–70% by weight.

The composition may also contain a detergent-active compound. If a detergent-active compound is included, it usually is in an amount of from 0.5–10%, usually 1–5%. Any well-known type of detergent active compound may be used, such as soaps, synthetic anionic, nonionic, amphoteric detergent surfactant and mixtures thereof. Preferably, a nonionic detergent surfactant is used, especially a low-foaming one. Suitable examples of such nonionic detergent surfactants can easily be found in M. Schick "Nonionic Surfactants" (1967).

The composition may furthermore contain other useful additives such as bleaching agents, bleaching agent activators, hydrotropes, fillers, perfumes, colouring agents, germicides, soil-suspending agents, aminopolyphosphonic acids and alkali metal or alkaline earth metal salts thereof, anti-corrosion agents such as fatty acids, benztriazole and so on.

As bleaching agents both the peroxygen bleaching agents and the chlorine-releasing agents are suitable for inclusion in the machine dishwashing compositions.

A typical example of a conventional machine dishwashing composition usually contains an alkali metal tripolyphosphate in an amount of from 20–60%, an alkali metal silicate in an amount of from 40–80%, a chlorine bleaching agent in an amount of from 1–5%, a low-foaming detergent surfactant in an amount of from 0.5–5%, and minor ingredients such as perfumes, colouring agents, hydrotropes, fillers, etc.

Usually, these products are formulated to have a pH (at 3 g/l in aqueous solution) of 11 and above, generally between 12 and 13.5. Typically, a conventional machine dishwashing com-position of the above type is formulated as follows:

| | % by weight |
|---|---|
| sodium tripolyphosphate | 35.5 |
| sodium metasilicate 0. aq. | 35.7 |
| sodium metasilicate 5. aq. | 25.0 |
| low-foaming nonionic surfactant | 1.5 |
| potassium dichlorocyanurate | 2.3 |

Such products are usually formulated in granular form by dry-mixing or co-granulating the various ingredients. The inclusion of the layered clay according to the present invention can be simply effected by adding the clay to the granular conventional machine dishwashing composition.

The invention will be further illustrated by way of Example.

EXAMPLE 1

A standard set of tumblers, soiled with a standard evaulation soil, was cleaned in a commercially available dishwashing machine, sold by Miele AG, Germany, under the name Miele G 550. The normal programme was used, at a temperature of 65° C. The water hardness was 9° German hardness.

In one experiment, 3 g/l of the above conventional machine dishwashing composition was used in the main wash step, in another experiment the following composition at the same dosage was used:

| | % by weight |
|---|---|
| sodium tripolyphosphate | 35.5 |
| sodium metasilicate 0. aq. | 35.7 |
| sodium metasilicate 5. aq. | 22.5 |
| low-foaming nonionic surfactant | 1.5 |
| potassium dichlorocyanurate | 2.3 |
| Laponite XLS | 2.5 |

In both experiments no rinse aid was used in the rinse step.

The tumblers when dry were visually assessed as to the spot formation, using the following scale:

1=no spots
2=1–5 spots
3=6–10 spots
4=11–20 spots
5=more than 20 spots.

The following results were obtained:

| | spot formation |
|---|---|
| product without Laponite XLS | 2.8–3.4 |
| product with Laponite XLS | 1.2–1.4 |

EXAMPLE 2

The same products as in Example 1 were tested in two other commercial dishwashing machines, sold by Bosch, Germany, under the name Bosch Mad. I and Bosch Mad. II. The programme coded JSO 30 was used (main wash temperature 65° C.) and as soil 1.5 g/l egg yolk was added to the wash liquor. The tumblers were assessed as to their visual appearance as in Example 1.

The following results were obtained:

| | spot formation |
|---|---|
| Bosch Mad. I | |
| product without Laponite XLS | 3.2 ± 1.3 |
| product with Laponite XLS | 1.6 ± 0.3 |
| Bosch Mad. II | |
| product without Laponite XLS | 3.0 ± 0.7 |
| product with Laponite XLS | 1.2 ± 0.4 |

EXAMPLE 3

In the same machine as in Example 1, using the same conditions (except the water hardness, which was 15° German hardness), the following formulation was tested in the same way as in Example 1.

| | % by weight |
|---|---|
| sodium tripolyphosphate | 30 |
| sodium metasilicate 0. aq. | 35 |

-continued

| | % by weight |
|---|---|
| sodium citrate 2. aq. | 12 |
| sodium carbonate | 10 |
| sodium sulphate | 10 |
| nonionic detergent | 1 |
| potassium dichlorocyanurate | 2 |
| (pH 0.3% aqueous solution 11.8) | |

The results were:

| | spot formation |
|---|---|
| product without Laponite XLS | 5.0 |
| product with Laponite XLS (instead of 5% sodium sulphate) | 2.8 |

EXAMPLE 4

In the same manner as in Example 1, the following composition was tested:

| | % by weight |
|---|---|
| sodium tripolyphosphate | 23.75 |
| sodium metasilicate $0.H_2O$ | 23.75 |
| sodium metasilicate $5.H_2O$ | 15.00 |
| sodium sulphate | 14.50←→34.50 |
| kandite (= haloysite) | 0←→20.00 |
| water | 3 |

The following results were obtained:

| % Clay | Spot Formation | Film Formation |
|---|---|---|
| 0 | 3.0 | 1.2 |
| 1 | 2.5 | 1.2 |
| 3 | 2.6 | 1.2 |
| 10 | 2.7 | 1.5 |
| 20 | 2.3 | 1.7 |

EXAMPLE 5

The following formulation was tested in the same manner as in Example 1 at different pH-values, using as clay Hormite (=an attapulgite).

| | % by weight |
|---|---|
| sodium tripolyphosphate | 23.75 |
| sodium metasilicate $0.H_2O$ | 23.75 |
| sodium metasilicate $5.H_2O$ | 15.00 |
| natrium sulphate | 34.50 |
| clay | 3.00 |

The following results were obtained:

| | without clay | | with clay | |
|---|---|---|---|---|
| pH | spot | film | spot | film |
| 11.45 | 3.0 | 1.2 | 2.8 | 1.4 |
| 10.20 | 4.2 | 1.4 | 2.4 | 1.4 |
| 8.50 | 5.0 | 1.6 | 4.0 | 1.4 |
| 7.10 | 5.0 | 2.4 | 5.0 | 1.2 |

We claim:

1. A powdered non-enzymatic mechanical dishwashing composition consisting essentially of:

(a) 0.5–10% of an active detergent;

(b) 10–90% of a builder salt;

(c) 1–5% of a chlorine bleaching agent; and (d) from 0.5–40% of a layered clay selected from the group consisting of the smectites, kaolins, illites chlorites, attapulgites and mixed layer clays;

the composition having a pH greater than 11 and no more than 13.5 at 3 g/l in aqueous solution.

2. The composition of claim , comprising 1–5% of (a), 30–70% of (b) and 0.5–20% of (d).

3. The composition of claim 1, wherein the layered clay is selected from the group consisting of hectorites, montmorillonites and bentonites.

4. The composition of claim 3, wherein the layered clay is a synthetic hectorite.

* * * * *